United States Patent [19]

Palmer et al.

[11] Patent Number: 4,894,881

[45] Date of Patent: Jan. 23, 1990

[54] WET/DRY VACUUM MACHINE

[75] Inventors: Gary E. Palmer, Roselle; Rick McCleod, Lake in the Hills, both of Ill.

[73] Assignee: Hako Minuteman, Inc., Addison, Ill.

[21] Appl. No.: 318,821

[22] Filed: Mar. 3, 1989

[51] Int. Cl.[4] ..... A47L 9/12

[52] U.S. Cl. ..... 15/328; 15/347; 15/352; 15/353; 55/216; 55/342; 55/372; 55/472

[58] Field of Search ..... 15/347, 352, 353, 328; 55/216, 342, 372, 472

[56] References Cited

U.S. PATENT DOCUMENTS

| | | | |
|---|---|---|---|
| 2,763,619 | 3/1954 | Martin | 15/353 X |
| 3,308,609 | 3/1967 | McCulloch et al. | 55/342 X |
| 3,606,631 | 9/1971 | Vassh et al. | 15/353 X |
| 3,618,297 | 11/1971 | Hamrick | 15/352 X |
| 4,055,405 | 10/1977 | Thun-Hohenstein | 15/353 X |
| 4,072,483 | 2/1978 | Doyle | 55/372 |
| 4,185,354 | 1/1980 | Brazier | 15/328 X |
| 4,463,474 | 8/1984 | Jacobs | 15/353 |
| 4,654,926 | 4/1987 | McCambridge | 15/328 X |

*Primary Examiner*—Chris K. Moore
*Attorney, Agent, or Firm*—Emrich & Dithmar

[57] ABSTRACT

A vacuum machine for collecting hazardous materials is adapted for wet or dry applications without diminishing the storage capacity of the reservoir.

5 Claims, 1 Drawing Sheet

WET/DRY VACUUM MACHINE

FIELD OF THE INVENTION

The present invention relates to the improvements in vacuum machines. In particular, it relates to an improved vacuum machine of the type used to collect hazardous materials such as asbestos or other toxic materials, and which may be used in such applications either for the collection of dry materials or for collection of liquids or slurrys (sometimes referred to as a "wet/dry vacuum").

BACKGROUND OF THE INVENTION

Vacuum machines used for industrial or commercial applications are well-known in the art. Typically, such industrial machines or "shop" vacuums have a large-capacity reservoir in the form of a top-filling tank or drum. For dry applications, the vacuum motor may be mounted to the underside of a lid which is received on and seals the tank. For applications where there is no collection bag used, the intake to the reservoir may be located in a side wall of the reservoir. In machines of this type, the intake of the reservoir typically is mounted as high as possible on the side wall of the reservoir to increase the storage capacity of the reservoir. However, such location for the intake precludes use of a collection bag in the form of a sack (i.e., having a completely open top) because if the top edge of "mouth" of the bag is folded over the top edge of the reservoir, the vacuum intake would be covered by the bag.

Thus, when it is desired to use a bag for collection of materials, a special connecting conduit may be used to connect the intake with the bag, in which case the storage capacity of the bag is necessarily less than the capacity of the reservoir.

As the toxic nature of asbestos became generally well-known, there arose a need for vacuum machines to collect asbestos debris (or other toxic waste materials) without dischaging the toxins in the exhaust of the vacuum motor. This required the development of several filtering stages. Typically, in a case of a dry vacuum machine, there might be a cloth or paper bag pre-filter and perhaps other stages of filtering. Usually, however, the final filter is a High Efficiency Particulate Air (or "HEPA" for short) filter. The incorporation of such pre-filter and HEPA filter stages made an otherwise conventional vacuum machine (sometimes called a "critical filter vacuum") useful in collecting toxic waste; but the inclusion of the additional filters reduces the storage capacity of the reservoir.

In an effort to increase storage capacity, debris collected by the machine and to accommodate it to "wet" applications, at least one commercial machine employs an extension or adapter wall for the reservoir which mounts on top of the reservoir and extends upwardly to accommodate and house the additional filter section. Thus, the filters do not extend into the reservoir which would diminish its capacity. In this type of machine, the conventional intake at the top of the normal reservoir is sealed, and a new intake is provided in the adapter, above the top edge of the reservoir. A collection bag could then be used without diminishing the storage capacity of the reservoir by clamping the top edge of the bag between the top edge of the reservoir and the bottom edge of the adapter.

To accommodate such a machine for both dry and wet applications, a cut off valve is provided in a location between the reservoir and the adapter, so that liquids are stored directly in the tank and the full storage capacity of the tank may be used to store liquids (at least up to the level of the intake).

However, for dry applications, this commercial machine requires a special connector conduit between the vacuum intake and a bag in the reservoir, thereby further reducing storage capacity for debris and rendering it inconvenient to change the bags.

Thus, there is a need to adapt industrial or commercial vacuum machines to critical filter vacuums for either wet or dry applications without diminishing the storage capacity of the reservoir and while permitting conventional top-fill collection bags to be used simply by folding the mouth of the bags over the top edge of the reservoir of the machine, rather than requiring special conduits or special types of bags in such applications.

SUMMARY OF THE INVENTION

The present invention includes a reservoir having an upright side wall defining an upper edge so that in the case where it is desired to use a disposable collection bag, the mouth of the bag is folded or draped over the upper edge of the side wall of the reservoir. An adapter comprising an upright side wall conforming to the shape of the side wall of the reservoir is mounted above the reservoir. The adapter includes an integral bottom wall which is received on the upper edge of the reservoir and seals against it. When a collection bag is used, it is sealed between the upper edge of the reservoir and the bottom wall of the adapter.

An intake conduit in the form of a 90° elbow extends through the side wall of the adapter, radially inwardly and then downwardly through the bottom wall of the adapter so that the inlet aperture of the intake conduit is above the upper edge of the reservoir, but the discharge aperture of the intake conduit is located within the reservoir (i.e., beneath the bottom wall of the adapter and below the upper edge of the reservoir). Thus, incoming debris whether wet or dry is directed inwardly through the side wall of the adapter and then downwardly through the bottom wall of the adapter and into the reservoir. A shut-off valve is positioned to close an aperture in the bottom wall of the adapter in the case of a wet vacuum.

The vacuum motor and necessary filters are mounted to the lid which is received on and mounted to the top of the adapter and housed within the adapter. Thus, the inlet opening of the intake conduit is located above the top of the reservoir, but the incoming debris is directed downwardly by the intake conduit and discharged into the reservoir. This enables use of a top-fill collection bag without any special connection conduit simply by folding the mouth of the collection bag over the upper edge of the reservoir and sealing the upper edge of the bag against the upper edge of the reservoir when the adapter is assembled to the reservoir. In the case of a wet application, the incoming debris does not impact on any of the filters which would reduce their capacity, and the capacity of the reservoir to store material is not diminished because the opening closed by the shut-off valve is located in the bottom wall of the adapter, above the discharge opening of the conduit.

Thus, the present invention provides for a critical filter vacuum machine which may be used for either wet and dry applications, and, in the case of dry applications, a top-fill collection bag may be used if desired. In either case the storage capacity of the reservoir is not diminished.

Other features and advantages of the present invention will be apparent to persons skilled in the art from the following detailed description of a preferred embodiment accompanied by the attached drawing wherein identical reference numerals will refer to like parts in the various views.

DETAILED DESCRIPTION OF A PREFERRED EMBODIMENT

Figure 1:
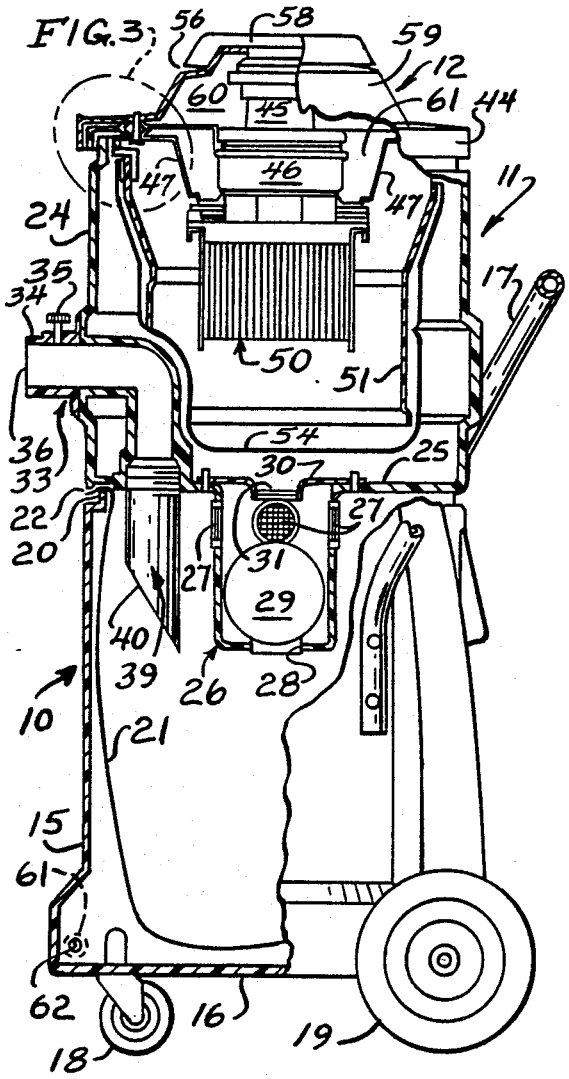
FIG. 1 is a left side view, partially sectioned and broken away to show the interior of a vacuum machine incorporating the present invention.

Referring now to the drawing, reference numeral 10 generally designates a reservoir in the form of an upright tank, at the top of which is mounted an adapter generally designated 11. A cover and motor assembly generally designated 12 is mounted above the adapter 11. The adapter may be connected to the reservoir and the cover assembly to the adapter by conventional latches, not illustrated.

The reservoir 10 includes a generally cylindrical side wall 15, an integral bottom wall 16 to which is mounted a handle 17, as well as forward caster wheels 18 and larger rear support wheels 19.

The upper edge of the upright side wall 10 defines a continuous horizontal edge 20. Within the reservoir 10, in the embodiment illustrated in FIG. 1, there is a flexible refuse or collection bag 21 having an upper edge 22 which is draped or folded over the upper edge 20 of the side wall 10 of the reservoir. Thus, the collection bag 21 does not have any special input adapter and may be a conventional top-fill sack, or it may be a specially marked container for disposing of hazardous or toxic materials. In any case, it is a wide-mouth down-filled sack or container. As used herein, the term "sack" refers to the shape of the bag in that it has an opening which is substantially the same size as the horizontal cross sectional area of the bag—i.e., the bag does not have a reduced opening nor any special connector to couple a conduit to the bag.

Turning now to the adapter 11, it includes an upright side wall 24 and an integrally formed annular bottom wall portion 25. A ball shut-off float valve, described presently, is located at the center of the annular wall portion 25.

A cage or housing 26 includes four apertures, three of which are seen in FIG. 1 and designated 27. Apertures may be provided with screens and are located at the top of the housing 26. At the bottom of the housing 26 there is another aperture 28, and a ball 29 is located within the cage 26. A plate or cover 30 is mounted to the annular wall section 25 by threaded fasteners, and it seals the top of the cage so that air may pass only through a central aperture 31 from the interior of the reservoir 10. Aperture 31 forms a seat for the ball 29. When the machine is used for liquid applications, the aperture 31 is closed as the ball 29 rises in response to rising level of liquid within the reservoir 10 and the cage 26, the liquid entering through the lower opening 28 in the cage.

Figure 2:
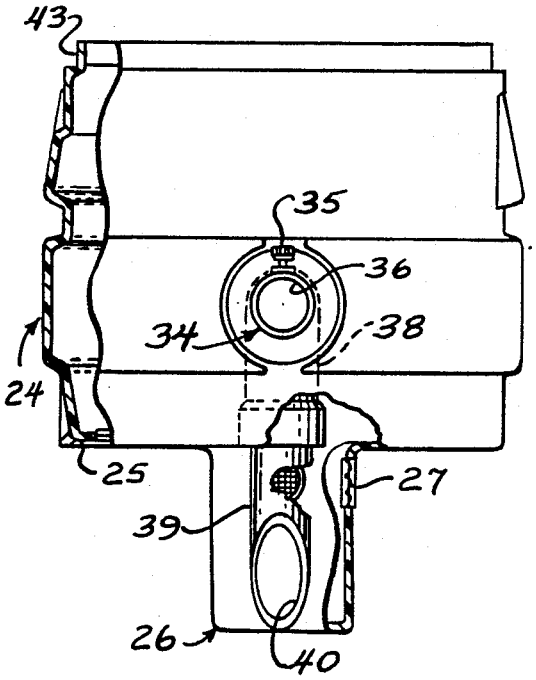
FIG. 2 is a front view of the adapter and intake assembly of the machine of FIG. 1, portions of which are broken away to illustrate the configuration of the side walls thereof.
Figure 3:
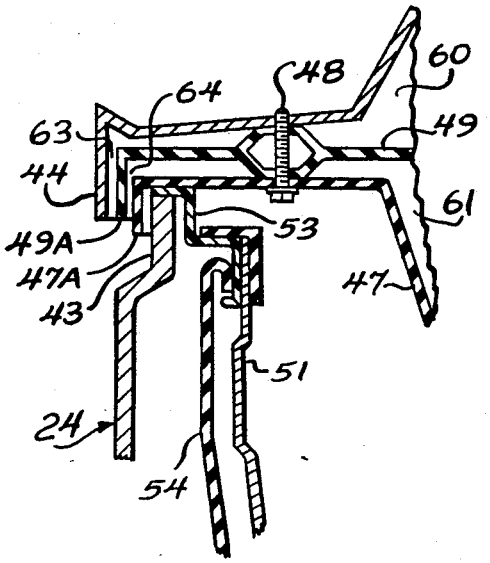
FIG. 3 is an enlarged vertical cross sectional view of a portion of the machine of FIG. 1 illustrating the assembly of the lid to the upper edge of the adapter.

Referring to both FIGS. 1 and 2, an intake conduit in the form of a 90° elbow and generally designated 33 is integrally formed with the adapter 11. That is, the adapter and intake conduit may be molded in plastic at the same time, using conventional spin-molding techniques. The intake conduit 33 includes an intake section 34 which is adapted to receive a conventional flexible vacuum hose which may be secured to the intake conduit by means of a thumb screw 35. The intake section 34 defines an inlet aperture 36.

As best seen in FIG. 1, the intake section 34 extends horizontally inwardly through the side wall 24 of the adapter 11 and then turns downwardly to form a vertical section 38 which extends through, and is sealed with, the bottom wall 25 of the adapter 11. An extension conduit 38 is threaded into the lower end of the vertical section 38. The lower end of the conduit 39 is formed along a slant to provide an oval discharge aperture 40 (FIG. 2) which is located within the collection bag 21 and lower than the opening 31 in the cover 30 of the cage which forms the seat for the ball 29. The opening 40 faces away from the valve 29 and opening 31 so that heavier materials may settle out under gravity and only lighter materials are drawn through the opening 31.

The upper edge of the side wall 24, designated 43 in FIG. 2 defines an enlarged opening; and the cover assembly 12 is received on the upper edge 43. The lid assembly may be latched to the adapter using conventional latches.

As best seen in FIG. 2, the cover assembly 12 includes a cover having a peripheral flange 44 which is spaced outwardly of the edge 43 of the adapter. A vacuum motor 45 and blower housing 46 are carried by an integral housing 47 in the form of a plate having a depending peripheral flange 47A which mounts to the upper edge 43 of the adapter. A motor hold-down pan 49, also having a peripheral flange 49A, both secures the motor and separates upper and lower chambers 60, 61 within the cover assembly (FIG. 1). Beneath the blower 46 is mounted a High Efficiency Particulate Air (i.e., "HEPA") filter 50.

A metal skirt 51 surrounds the blower 46 and HEPA filter 50; and it is mounted at its upper portion by means of a connector 53 which is attached to the housing 47. A cloth filter bag 54 is mounted to the top of the skirt 51; so that air being evacuated from the reservoir passes through the intake aperture 31, the cloth filter bag 54, HEPA filter 50 and lower chamber 61 from which clean air is evacuated back into the atmosphere through an annular opening 64 between flanges 47A and 49A. Cooling air for the motor 45 enters through an annular opening 56 beneath a top 58 and the cover, is forced through the upper chamber 60 and is then evacuated through the annular opening 63.

The operation of the critical filter vacuum machine has already been described, but it will be observed that in the case of collecting dry debris, a flexible sack 21 (which may be properly marked, for example, for disposing of hazardous material or the like) has an upper edge 22 which is folded over the upper edge 20 of the reservoir 10. When the adapter 11 is received on the reservoir 10 and secured by latches, it traps the upper edge 22 of the bag 21 and seals the entire periphery of the reservoir. Air and debris are taken in through the inlet conduit 33 and the extension conduit 39, and the debris is deposited directly downwardly so that heavier materials may settle out at the bottom of the bag 21. Lighter materials and particles entrained in the air are then processed by the filters mentioned above, the coarser particles being filtered out by the cloth filter 54 and finer particles being filtered by the HEPA filter 50.

In the case of wet applications, the bag 21 is not used, and liquid or slurry materials are again directed to the interior of the reservoir 10 by means of the intake conduit 33. Since the inlet aperture 36 is above the valve seat opening 31 in the bottom wall of the adapter, as the liquid level builds up within the reservoir 10, the ball valve 29 will float and seal off the opening 31 when the liquid reaches a predetermined level, which is below the level of the intake assembly.

The liquid content of the reservoir 10 may be discharged through an opening 61 in the lower portion of the reservoir which is provided with a manual valve 62.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. In a vacuum machine for removing hazardous materials in liquid or dry condition, the improved combination comprising: a reservoir for storing collected materials, said reservoir including an upright side wall defining an upper edge for receiving and holding the inlet edge of a collection container extending downwardly into the reservoir; an adapter comprising a side wall and an integral bottom wall received on said reservoir and sealingly engaging said upper edge of said reservoir, said bottom wall defining an air intake aperture communicating the interior of said reservoir with the interior of said adapter; an intake conduit having a first section extending through the side wall of said adapter for receiving an intake hose and a second section extending downwardly through said bottom wall of said adapter and into said reservoir; a float valve in operative relation with said air intake aperture of said adapter bottom wall for sealing said aperture when the liquid level in said reservoir reaches a predetermined level; a lid mounted to cover the top of said adapter; a vacuum motor beneath said lid and at least partially encompassed by said adapter side wall; filter means for filtering air passing through said adapter; whereby said machine may be used as a liquid vacuum machine without a collection container or as a dry vacuum machine with the mouth of a sack folded over said upper edge of said reservoir and sealed thereagainst when said adapter is assembled thereto.

2. The apparatus of claim 1 characterized in that the inlet opening of said intake conduit is adjacent said side wall of said adapter and above said upper edge of said reservoir, said intake conduit extends from said inlet opening radially inwardly of said adapter and thence downwardly to define a discharge opening beneath said upper edge, and said air intake aperture in said bottom wall of said adapter is above said discharge opening of said intake conduit.

3. The apparatus of claim 2 wherein the portion of said intake conduit extending from the side wall of said adapter to the bottom wall thereof is integrally molded with said adapter side wall and bottom wall.

4. The apparatus of claim 3 wherein said float valve comprises a housing integrally molded in the center of said adapter bottom wall and extending below said bottom wall, said housing defining a plurality of upper apertures for air passage and a lower aperture for liquid passage; a float ball in said housing for upward motion in response to liquid in said housing; and a plate mounted to seal said adapter bottom wall above said housing and defining said air intake opening to the interior of said adapter, said ball sealing said air intake opening to said adapter when the liquid in said housing reaches a predetermined level.

5. The apparatus of claim 1 wherein said motor drives a blower located within said adapter for drawing air through said intake conduit, said reservoir, said intake aperture and said adapter and for exhausting the air into the atmosphere; said apparatus further comprising a high efficiency particulate air filter for filtering said air passing into said blower; a rigid skirt surrounding said blower and having an opening therein; and a cloth filter covering the opening in said rigid skirt for filtering the air before it passes into said high efficiency particulate air filter.

* * * * *